United States Patent [19]

Tengler

[11] Patent Number: 4,596,428

[45] Date of Patent: Jun. 24, 1986

[54] MULTI-CONDUCTOR CABLE/CONTACT CONNECTION ASSEMBLY AND METHOD

[75] Inventor: John N. Tengler, Chico, Calif.

[73] Assignee: Minnesota Mining and Manufacturing Company, St. Paul, Minn.

[21] Appl. No.: 588,652

[22] Filed: Mar. 12, 1984

[51] Int. Cl.[4] ..... H01R 4/66

[52] U.S. Cl. ..... 339/14 R; 339/17 F

[58] Field of Search ..... 339/14, 17 F, 176 MF

[56] References Cited

U.S. PATENT DOCUMENTS

| | | | |
|---|---|---|---|
| 3,634,806 | 1/1972 | Fergusson | 339/14 R |
| 3,731,251 | 5/1973 | Sinclair | 339/17 F |
| 4,094,566 | 6/1978 | Dola et al. | 339/14 R |
| 4,260,209 | 4/1981 | Zell et al. | 339/14 R |
| 4,415,216 | 11/1983 | Narozny | 339/17 F X |
| 4,464,003 | 8/1984 | Goodman et al. | 339/14 R X |

*Primary Examiner*—Eugene F. Desmond

*Attorney, Agent, or Firm*—Renner, Otto, Boisselle & Lyon

[57] ABSTRACT

Plural electrical conductors, for example those contained in transmission line cable or in other devices, are connected to respective electrical contacts positioned on a contact carrier. The carrier has relatively raised and recessed surface portions that facilitate separating the contacts, guide signal conductors to respective contacts and isolate ground conductors from the respective junctions of signal conductors and contacts. A programmable ground bus connects all the ground conductors and has selectively provided signal/ground tabs bendable to engage respective signal conductors and contacts. The ground bus and contacts have a partial soldered coating and a laser scans respective junctions of conductors with contacts and/or with the ground bus to flow the solder and form secure mechanical and electrical connections. A strain relief body molded about at least part of the junctions, contact carrier, contacts, conductors and bus forms a unified structure. Moreover, the contact carrier includes partition walls separating the contacts in parallel rows and cooperating with a cover to form discrete compartments for the respective contacts and into which electrically conductive members may be inserted for connection with respective contacts.

46 Claims, 19 Drawing Figures

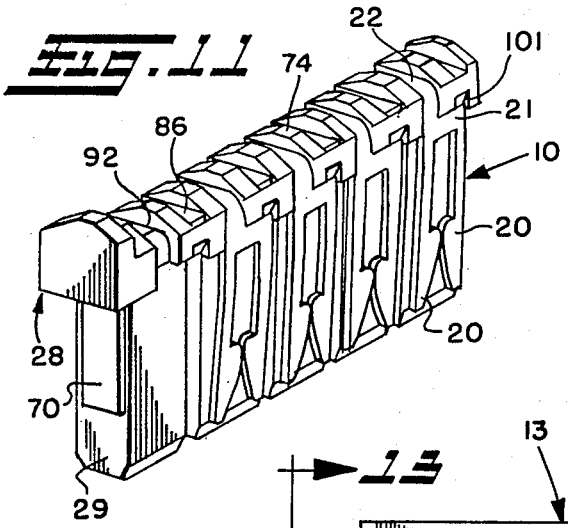
Fig. 11
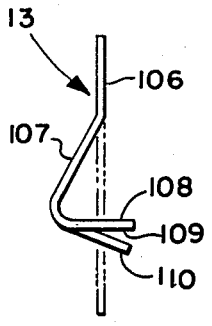
Fig. 13
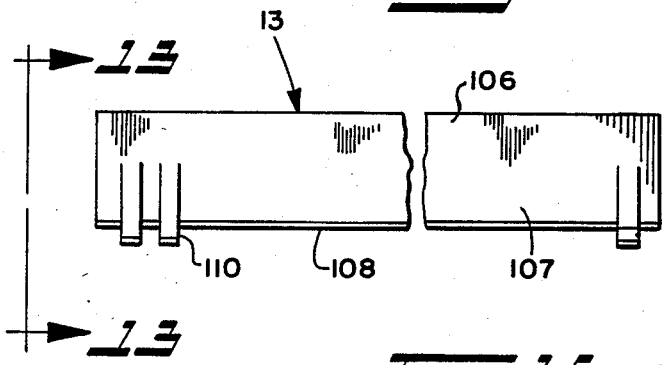
Fig. 12
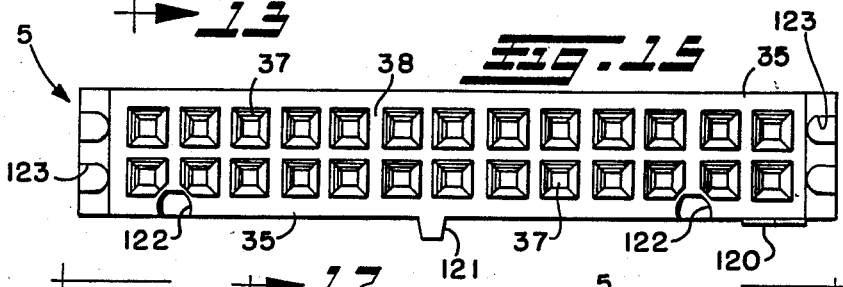
Fig. 15
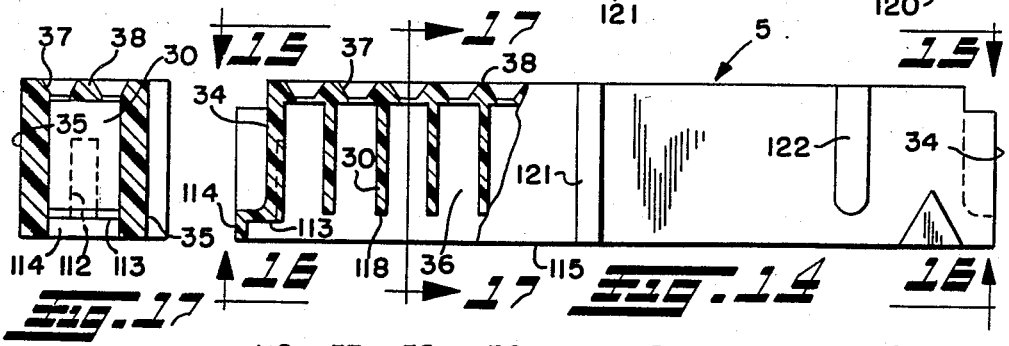
Fig. 17
Fig. 14
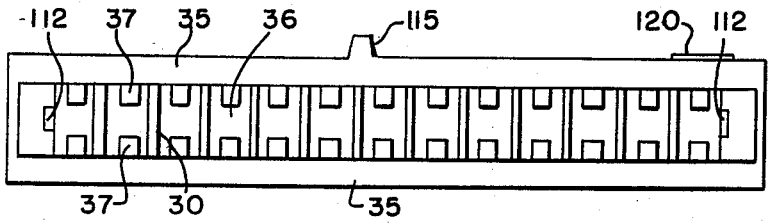
Fig. 16

MULTI-CONDUCTOR CABLE/CONTACT CONNECTION ASSEMBLY AND METHOD

The present invention relates generally to a multi-conductor cable/contact connection assembly and method, and, more particularly, to a connection assembly especially useful in conjunction with transmission line cables of flat or ribbon multi-conductor type with ground signal isolation and to a method of making such assembly.

BACKGROUND

In the electronics field a variety of techniques have been employed to terminate electrical cables. Electrical cables may have one or more electrical conductors covered or separated by electrical insulation. Typically an electrical connector (cable termination) is coupled to the end of the cable to form a cable termination assembly which facilitates connecting conductors of the cable to other cables, terminal boards, modular equipment used in computers, etc. Important features of such cable termination assemblies are facility of manufacture and/or use, mechanical strength, security and integrity of electrical connections made therein and thereby, and cost efficiency.

Multi-conductor electrical cables have enjoyed widespread use in the electronics industry. One such multi-conductor cable includes plural wires, each including a conductor covered by its own insulation, physically bundled together by a fastener, external sheath or the like. Other multiconductor cables commonly referred to as flat or ribbon cables include plural electrical conductors electrically isolated and held in relative parallel coplanar relation by electrical insulation forming an integral structure. The insulation for such ribbon cable may be of various electrically non-conductive materials such as plastic or plastic-like materials, polytetrafluoroethylene, fiberglass, etc. Typical flat ribbon cables may have multiple conductors therein numbering more than eighty.

In some uses of ribbon cable, such as for high speed signal transmission purposes, it may be desirable electrically to isolate adjacent signal carrying conductors (hereinafter signal conductors, although some also may be connected to a reference potential, e.g., ground potential), by providing, for example, one or more conductors therebetween that are maintained at a reference potential, such as ground potential. The isolating conductors are commonly referred to as ground conductors, it however being appreciated that the reference potential may be other than ground potential, and may be achieved, for example, by connecting alternate conductors of the cable to a ground reference potential.

Examples of prior electrical connectors for electrical cables having signal conductors and ground (isolation) conductors are disclosed in U.S. Pat. Nos. 4,094,564 and 4,310,208. Although the connectors of these patents have desirable attributes, they are coupled to the cable at its end and still require considerable preparation of the cable conductors to position the same for connection in the bifurcated ends of respective contacts that are supported in a directly molded contact carrier body. Such preparation of the conductors is time consuming and a relatively delicate procedure to assure that the conductors are properly formed, are not short circuited, and properly engaged with respective contacts.

BRIEF SUMMARY OF INVENTION

The present invention provides an electrical connection assembly or apparatus for terminating conductors of an electrical cable, especially of the flat or ribbon transmission line type having plural parallel coplanar signal and ground conductors held in positional relationship by the cable insulation. The invention may be practiced to effect connection to the end of a cable or to an intermediate portion of the cable allowing, for example, daisy chain usage. Electrical and mechanical integrity of the various conductor connections and the conductors themselves is improved because deformation of the conductors out of the cable plane is minimized, ground conductors are physically separated from signal conductors, and junctions of the respective conductors with contacts and/or with a ground bus is secured mechanically and electrically by respective solder connections effected in accordance with the method of the invention. Moreover, close packing of the contacts while maintaining isolation of the electrical signal and ground conductors from one another is accomplished.

According to one aspect of the invention an apparatus for terminating plural electrical conductors, for example of a multi-conductor cable thereby to form a cable termination assembly therewith, comprises plural electrical contacts including a connecting portion for connecting electrically with a respective electrical conductor and a coupling portion for electrically coupling with another member; a contact carrier for supporting a plurality of the contacts in close packed relation, the contact carrier including a separating device for separating respective contacts placed on the carrier; electrical junctions between respective contact connecting portions and conductors, and a body molded about at least part of the junctions, carrier, contacts and conductors to form a unified structure.

According to another aspect of the invention, an apparatus for terminating plural electrical conductors, for example of a multi-conductor cable thereby to form a cable termination assembly therewith, comprises plural electrical contacts including a connecting portion for connecting electrically with respective electrical conductors and a coupling portion for electrically coupling with another member, a contact carrier for supporting a plurality of the contacts, the contact carrier including a separating device for separating respective contacts placed on the carrier and a displacing device for displacing a portion of at least some of the conductors out of the plane of a proximate portion of others of the conductors when the latter are brought into electrical contact with respective contact connecting portions, and a holder for securely holding in relative position at least part of the carrier, electrical contacts and such portions of the conductors.

According to still another aspect of the invention, an apparatus for terminating plural electrical conductors, for example of a multi-conductor cable thereby to form a cable termination assembly therewith, comprises plural electrical contacts including a connecting portion for connecting electrically with respective electrical conductors and a coupling portion for electrically coupling with another member; a contact carrier for supporting a plurality of the contacts, the contact carrier including a separating device for separating respective contacts placed on the carrier and a guide device for guiding respective conductors to connect electrically with respective contacts; electrical junctions between respective contact connecting portions and electrical conductors; a programmable bus for coupling in electrical parallel selected ones of the conductors; and a holder for holding securely in relative position at least part of the junctions, carrier, contacts, conductors and bus.

According to a further aspect of the invention, a contact carrier for supporting a plurality of electrical contacts and a plurality of electrical conductors ordinarily positioned in generally parallel coplanar relation to each other comprises a separating device for separating respective electrical contacts placed on the carrier, a guide device for guiding respective electrical conductors to positions to form electrical junctions with respective electrical contacts, and a displacing device for displacing a portion of at least some conductors out of the plane of a proximate portion of other conductors.

According to yet another aspect of the invention, a method of making an apparatus for terminating plural electrical conductors includes placing a plurality of electrical contacts on a contact carrier, placing a plurality of electrical conductors respectively in electrical engagement with such contacts to form respective junctions, wherein at least one of the contacts and conductors has attaching material thereon, and applying electromagnetic radiation to such junctions to cause the attaching material to join respective electrical contacts and conductors. The method also preferably includes maintaining a separation between respective contacts and between respective signal and ground conductors, and the application of electromagnetic radiation by scanning respective junctions using a laser. Such laser scanning also may be employed to attach respective ground or reference potential conductors to a common ground bus.

Accordingly, it is a primary object of the present invention to terminate conductors of an electrical cable, especially a flat cable, but not necessarily at the end of the cable.

Another object is to terminate transmission line cable.

An additional object is to facilitate terminating an electrical cable, especially of the flat transmission line type.

A further object is to minimize unshielded conductor areas when transmission line signal conductors and ground conductors are terminated.

Still another object is to improve the integrity of electrical and mechanical connections between conductors and contacts in the cable termination assembly, especially of the type employing flat transmission line type cable.

Still an additional object is to reduce the time required and/or the cost for terminating transmission line or other electrical cable, especially of the flat multi-conductor type.

Still a further object is to provide programmability of signal grounds in the multi-conductor cable termination assembly.

Even another object is to facilitate daisy chain type termination of multi-conductor electrical cables, especially of flat transmission line type.

These and other features, objects and advantages of the present invention will become more apparent from the following detailed description.

To the accomplishment of the foregoing and related ends, the invention, then, comprises the features hereinafter fully described in this specification and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF DRAWINGS

In the annexed drawings:

FIG. 11 is an isometric view of the contact carrier in sub assembly with a plurality of electrical contacts positioned thereon, the first and second contact positions, though, being vacant for purposes of illustration;

FIG. 12 is a side elevational view of a ground bus according to the present invention;

FIG. 13 is an end elevational view of the ground bus looking generally in the direction of the arrows 13—13 of FIG. 12;

FIG. 14 is a side elevational view, partly broken away in section, of a cover for the cable termination assembly;

FIGS. 15 and 16 are, respectively, bottom and top plan views of the cover looking generally in the direction of the arrows 15—15 and 16—16 of FIG. 14, respectively;

FIG. 17 is a transverse section through the cover taken along the line 17—17 of FIG. 14.

DETAILED DESCRIPTION

Figure 1:
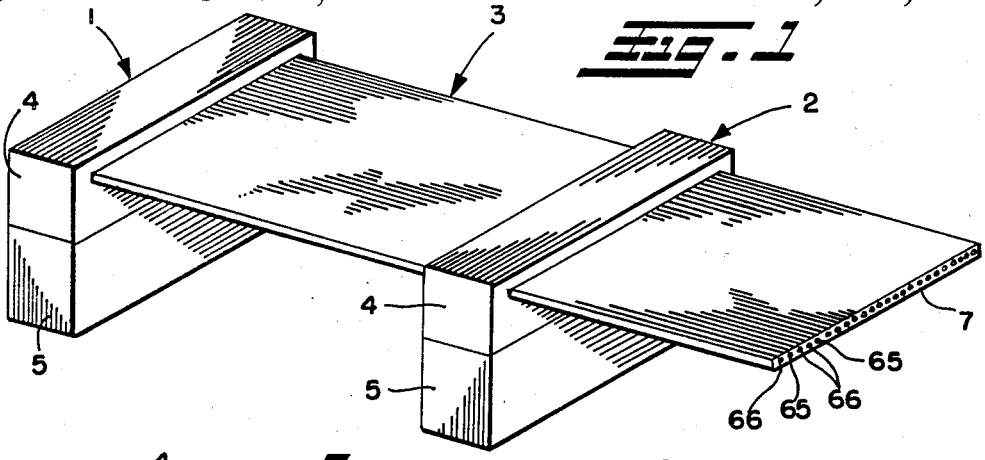
FIG. 1 is an isometric view of a cable end termination assembly and cable intermediate termination assembly for a flat multi-conductor transmission line electrical cable according to the present invention.

Referring now in detail to the drawings, wherein like reference numerals designate like parts in the several figures, and initially to FIG. 1, cable connectors/terminations in accordance with the present invention are generally indicated, respectively, at 1 and 2 and coupled to a flat multi-conductor transmission line electric cable 3. The termination 1 is a cable end termination, being located at the end of the cable 3, and the termination 2 is a cable intermediate termination, being located, for example, in daisy chain fashion intermediate the ends of the cable. The combination of a cable termination and the cable itself is herein denoted a cable termination assembly. Each termination 1, 2 includes a molded strain relief body 4 which forms a secure integral structure with the cable 3 and with various internal portions of the termination, as will be described in greater detail below, and a cover 5, which helps to protect contacts in the termination, to isolate those contacts, and to guide external members into engagement with the respective contacts. The terminations 1, 2 are shown as female type but may be of the male type having pin contacts, for example, protruding outward from the molded strain relief body 4, in which case the cover 5 may be eliminated or appropriately modified.

Electrical signals carried by respective signal conductors 6S in the cable 3 are coupled by the terminations 1, 2, for example, in electric circuit relation with respective external members, such as pin contacts of a terminal board of a computer system, another electrical connector, sockets, etc. Ground conductors 6G in the cable 3 provide ground isolation of respective signal conductors. In the illustrated embodiment, the signal conductors 6S are separated or isolated by a private pair of ground conductors 6B, there being two ground conductors between adjacent signal conductors. As will be seen, the ground conductors may be connected in electrical parallel relation at each termination 1, 2 and coupled via one or more of the contacts of the termination to pins, contacts, etc. of the external member (not shown) to which the termination may be connected. As is customary, the conductors are maintained in their spaced parallel coplanar relation by insulation 7 of Teflon or other suitable material that desirably has impedance characteristics suitable for high speed transmission of signals by signal conductors 6S.

According to the preferred embodiment and best mode of the present invention the cable terminations 1, 2 are employed with flat ribbon type cable 3 of the multi-conductor transmission line type as illustrated. However, it will be appreciated that principles of the invention may be employed with other electrical cables and conductors.

Figure 2:
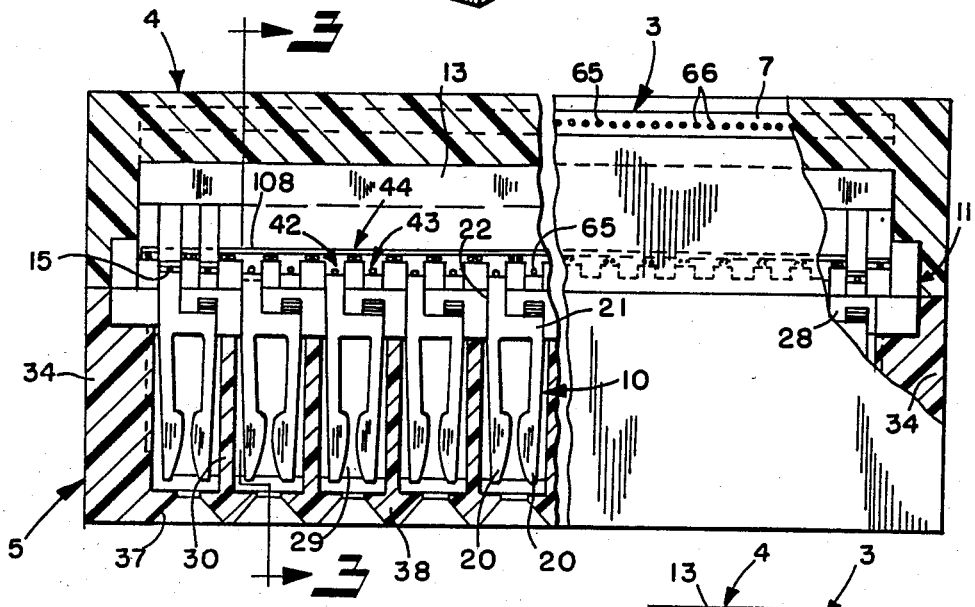
FIG. 2 is a side elevational view, partly broken away in section, of the intermediate termination assembly of FIG. 1.
Figure 3:
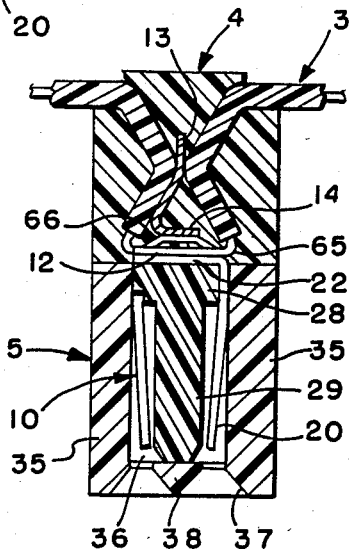
FIG. 3 is a transverse section through the assembly of FIG. 2 taken substantially along the line 3—3 thereof.

In FIGS. 2 and 3, the components of a termination according to the invention, such as cable intermediate termination 2, can be seen to include a plurality of electrical contacts 10, an electrically non-conductive carrier II for supporting the contacts in electrical isolation, electrical junctions 12 between respective contacts and signal conductors 6S of the cable 3, and the molded strain relief body 4 molded about at least a part of the junctions, carrier, contacts and conductors to form a unified structure therewith. Also included at least in part within the molded strain relief body are an electrically conductive ground bus 13, electrical ground junctions 14 between the ground bus and ground conductors 6G of the cable, and selectively provided electrical junctions 15 between the ground bus and respective signal conductors which also are electrically connected at respective junctions 12 to respective contacts. The foregoing termination components are further shown individually or in sub-assembly in FIGS. 4–18 along with the cover 5 provided in the termination of the illustrated female type. Initially, however, such components and their interrelationship will generally be described with primary reference to FIGS. 2 and 3.

In the preferred embodiment and best mode, each contact 10 is a fork contact having a pair of tines 20 between which a conventional pin contact or the like may be inserted for electrical connection therewith. Each contact also has a web or base 21 supporting the tines and a contact arm 22 extending from the base oppositely the tines and then inwardly at right angles to the general planar extent of the support base and tines. The contact arm is L-shape as seen in FIG. 3 and offset to one side of a center plane passing between the tines as seen in FIG. 2.

The contacts 10 are arranged on opposite sides of the carrier 11 in a dual in-line pattern with the contacts in one row (on one side) transversely aligned with respective oppositely facing contacts in the other row. Consequently, the inwardly extending contact arms 22 of the contacts in one row are offset in one longitudinal direction (relative to the carrier) while those of the contacts in the other row are offset in the opposite direction to facilitate close packing of the contacts. As is preferred, the contact arms of the contacts in one row alternate with those of the contacts in the other row at spaced intervals substantially or identically corresponding to the spacing between signal conductors 6S in the cable 3 whereby the termination 2 need not be much greater in width than the cable.

The electrically non-conductive carrier 11, which may be molded for example by conventional injection molding techniques from material having desirable strength and dielectric properties, has an elongate main support body 28 on which the contacts 10 are supported at their bases 21 and contact arms 22 as shown, and a plurality of longitudinal spacer/divider wall partitions 29 which extend between and hence separate or isolate the tines 20 of the contacts 10 of respective transversely aligned pairs thereof. The longitudinal wall portions 29 are longitudinally aligned and spaced for interfitting receipt of transverse spacer/divider wall portions 30 of the cover 5.

The transverse wall portions 30 define with the end walls 34 and side walls 35 of the cover 5 a plurality of longitudinally spaced cells 36. The cells 36 are sized to receive a respective pair of contacts 10 and associated longitudinal wall portion 29. The longitudinal wall portion 29 transversely divides each cell into sub-cells accommodating the tines 20 of a respective contact 10 within a measure of confinement for the tines to avoid substantial physical displacement, distortion or the like in response to the force of a pin contact inserted to engagement therewith via access holes 37 in the juncture wall 38 of the cover. Such access holes 37 are tapered in the manner illustrated to help guide pin contacts into respective sub-cell portions. The end of each longitudinal wall portion also is tapered at its longitudinally extending edges and abuts the inner surface of the juncture wall 38 intermediate respective transversely spaced access holes 37 as best seen in FIG. 3.

The main support body 28 of the contact carrier 11 has relatively raised and recesed surface portions which alternate along the length of the support body and give rise to the crenellated pattern seen in FIG. 2. The recessed portions consist of alternating portions generally indicated at 42 and 43 which essentially are of like configuration but transversely oppositely disposed for accommodating the contact arms 22 of respective oppositely facing contacts 10 of transversely opposed pairs thereof. Between respective alternating portions 42 and 43 are the raised portions generally indicated at 44 which serve, as explained further below, to guide and separate the contacts, guide signal conductors 6S to respective contacts, isolate ground conductors 6G from respective junctions 12 of signal conductors and contacts, and provide displacement and support for ground conductors 6G in contact with the ground bus 13.

During the assembly procedure for the termination 2, the ribbon cable 3 is bent to its generally hourglass profile seen in FIG. 3 at its point of joinder with the termination. At the top of such hourglass profile (as viewed in FIGS. 2 and 3), the cable extends in opposite directions generally in a common plane. At the bottom or base of such profile, the cable has the insulation thereof stripped from the conductors 6 as shown. After the electrical junctions 12, 14 and 15 have been effected as in the preferred manner discussed below, the strain relief body 4 is molded about such profile portion of the cable and at least a part of the junctions, carrier 11, contacts 10, conductors and ground bus 13 to form a unified structure therewith. Thereafter, the depending portions of such unified structure are mated in the cover 5 and the cover and strain relief body 4 joined together such as by an ultrasonic welding process, cement, etc.

Having generally discussed the components of the termination 2 and their interrelationship, a further description thereof and their assemblage will now be given with additional reference being had to FIGS. 4–18. It is noted that the various references herein to vertical, horizontal, top, bottom, etc. are made in relation to the orientation of the termination as shown in FIGS. 2 and 3, unless otherwise indicated, to facilitate description thereof, although it will be appreciated that the termination may be oriented otherwise than as shown.

The Contacts

Figure 4:
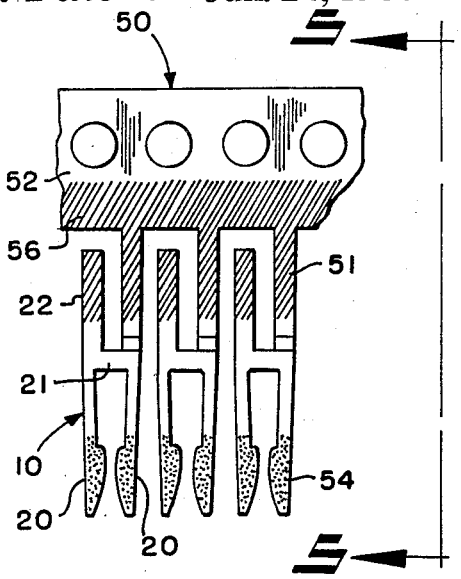
FIG. 4 is a fragmentary plan view of a contact comb according to the present invention.
Figure 5:
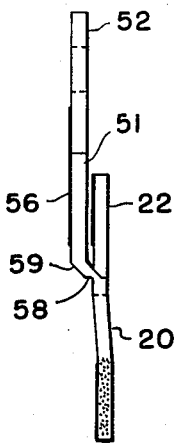
FIG. 5 is an end elevational view of the contact comb looking generally in the direction of the arrows 5—5 of FIG. 4.
Figure 6:
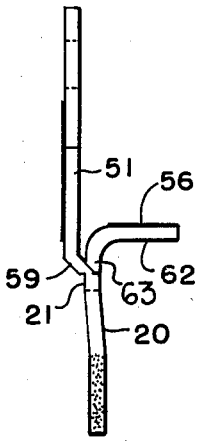
FIG. 6 is an end elevational view similar to FIG. 5 but showing a contact connecting arm of a contact in the comb bent to position for subsequent assembly.

With reference to FIGS. 4–6, a plurality of essentially identical contacts 10 may be readily formed from a band of conductive metal such as nickel silver alloy to form the illustrated contact comb 50. In FIG. 4, three partly formed contacts are shown connected by respective carrier arms 51 to a common carrier strip 52 formed during manufacture of the contacts as by a die cutting or stamping operation. The carrier arms and carrier strip provide convenient means facilitating manipulation of the contacts during subsequent forming operations and assembly in the termination 2, for example.

To improve the electrical connection between a contact 10 and a member, such as a pin contact, between the tines 20, the tines at their contacting distal ends are plated as seen at 54 with gold, palladium, silver or other desired material having a high electrical conductivity and greater resistance to impedance causing oxidation than the material of which the balance of the contact is formed, such as the above noted nickel silver alloy. Since the plating 54 is located generally only in the contacting area of each tine and is relatively thin, only a minimum amount of such relatively costly material is required.

The contact comb 50 also has applied to one surface thereof a solder coating 56 such as on the order of 0.002 inch thickness which at least overlies that portion of the contact arm 22 which, as indicated below, is bent to form a junction contact portion of the contact arm. Such solder coating may be conveniently applied as a generally longitudinally continuous coating on the metal band prior to its being die cut or stamped to form the intermediate product or contact comb 50 seen in FIGS. 4 and 5.

It is noted that during the die cutting or stamping operation the carrier arm 51 is sharply bent and scored at its point of joinder to the contact base 21 to provide a weakened zone at 58 for break-away from the respective contact. As seen in FIG. 5, each partly formed contact 10 resides in a plane parallel to but slightly offset from the plane of the balance of the contact comb 50, while remaining joined thereto by an angled bent portion 59 of the carrier arm which terminates at the score or break-away zone 58. For purposes discussed hereinafter, the angle of the bent portion 59 is selected to correspond to a cooperating sloped surface on the contact carrier 11, such angle, for example, being 45° in relation to the plane of the contact base 21 and tines 20.

To finish formation of the contacts 10, the contact arms 22 are gradually bent intermediate their lengths to an L-shape as seen in FIG. 6. Such bending brings a junction connecting portion 62 of the contact arm into right angular relationship to the plane of the contact base and remainder 63 of the contact arm, with the solder coating 56 thereon facing away from the tines 20 or upwardly as viewed in FIG. 6.

The Contact Carrier

Figure 8:
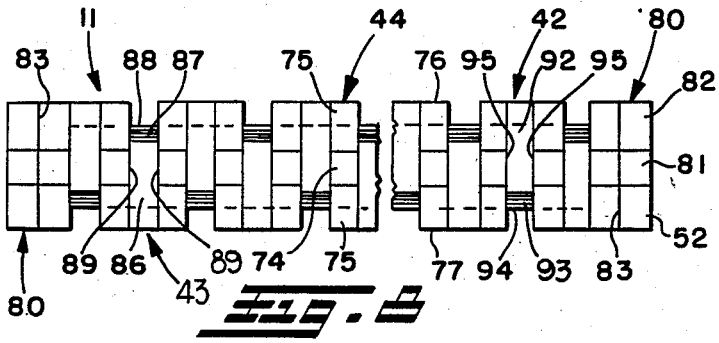
FIG. 8 is a top plan view of the contact carrier looking generally in the direction of the arrows 8—8 of FIG. 7.
Figure 9:
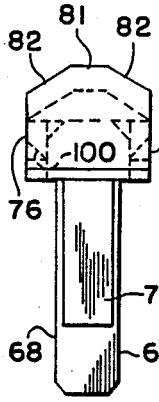
FIG. 9 is an end elevational view of the contact carrier looking generally in the direction of the arrows 9—9 of FIG. 7.
Figure 7:
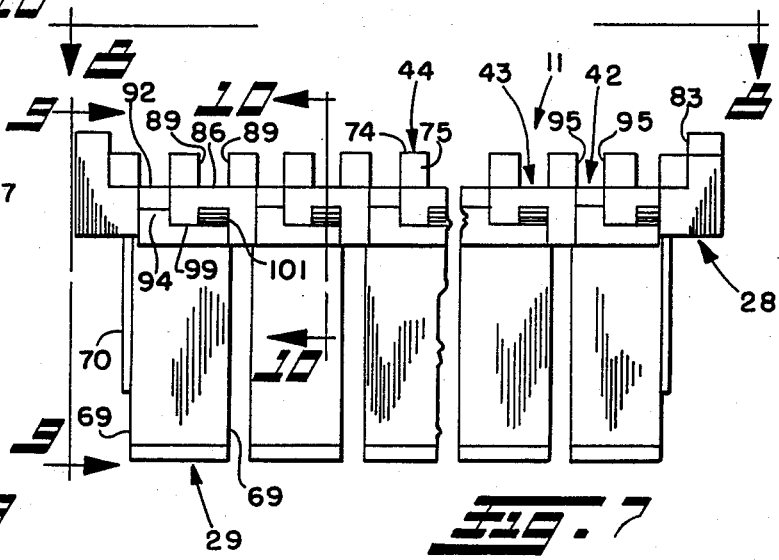
FIG. 7 is a side elevational view of a contact carrier according to the present invention.

FIGS. 7–10 are enlarged views of the contact carrier 11 separate and apart from the other components of the termination 2. In FIGS. 7 and 9, the longitudinal wall portions 29 can be seen to be essentially identical, each having parallel side surfaces 68 and parallel end faces 69. The opposed end faces 69 of adjacent longitudinal wall portions are spaced to receive with a close fit the transverse wall portions 30 of the cover 5 (FIG. 2). The endmost longitudinal wall portions also can be seen to have respective locating tabs 70 on their outermost end faces, which tabs extend from the main body 28 part way along the length of such longitudinal wall portions. The locating tabs 70 also are transversely narrower than the longitudinal wall portions as illustrated in FIG. 9. As will be seen below, the end walls of the cover 5 have corresponding slots in the interior surfaces thereof which closely receive the locating tabs 70 for proper positioning of the cover in relation to the contact carrier, or vice versa.

Referring now in detail to the main body 28, the raised surface portions 44 thereof each has at its top side a transversely extending, centrally disposed horizontal ground conductor land or support surface 74 intermediate sloped ground conductor transition surfaces 75. The transition surfaces 75 extend transversely and slope downwardly from the ground conductor land, as at an angle of about 30° to the horizontal, and terminate at vertical side surfaces 76 and 77 which define the longitudinally extending sides of the main body. As will be appreciated, the sloped surfaces facilitate gradual transition of ground conductors out of the plane of signal conductors electrically connected to respective contact arms.

Figure 10:
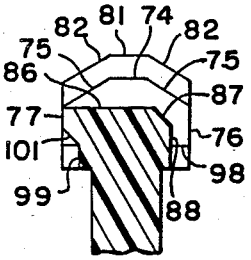
FIG. 10 is a fragmentary transverse section through the contact carrier taken along the line 10—10 of FIG. 7.

The main body 28 also has at its ends ground bus aligning wall portions 80 which have a top side surface configuration similar to that of the raised surface portions 44 but in elevated relation. Accordingly, each ground bus aligning wall portion 80 has a centrally disposed horizontal surface 81 and sloped surface 82 as seen in FIGS. 8 and 10. The ground bus aligning wall portions 80, being elevated in relation to the inwardly adjacent endmost raised surface portions 44, also have interior walls 83 projecting above adjacent raised surface portions 44 which serve as longitudinal alignment stops or abutments for respective ends of the ground bus 13 as seen in FIG. 2.

As previously indicated and shown, the raised surface portions 44 alternate with the recessed surface portions 42 and 43. The recessed surface portions 42 and 43 also alternate with respect to each other whereby each intermediate raised surface portion 44 separates an adjacent recessed portion from an oppositely disposed adjacent recessed surface portion. On the other hand, each recessed surface portion is bounded by associated pairs of raised surface portions.

As best seen in FIGS. 8 and 10, each recessed surface portion 43 at its top side has a horizontal contact arm support surface 86 in recessed parallel relation to the horizontal ground conductor land surface 74 of adjacent recessed surface portions 44. Such contact arm support surface 86 extends transversely from the main body side surface 77 to a sloped contact arm transition surface 87 which terminates at a vertical surface 88 recessed in relation to the other side surface 76 of the main body. The contact arm support surface 86, transition surface 87 and vertical surface 88 are all longitudinally bounded by vertically transversely extending guide walls 89 of adjacent raised surface portions 44. The opposed guide walls 89 corresponding to each recessed surface portion are spaced to guide, closely accommodate and longitudinally locate therebetween the contact arm 22 of a respective contact when the contact is placed in supporting relation on the contact carrier as illustrated in FIG. 11.

The other alternating recessed surface portions 42 are similarly configured but oppositely disposed. Accordingly, each recessed surface portion 42 has a horizontal contact arm support surface 92 extending from the side surface 76 to a transition surface 93 which in turn terminates at a vertical surface 94 recessed in relation to the other side surface 77. Also, the contact arm support surface 92, transition surface 93 and vertical surface 94 are bounded by vertical transversely extending guide walls 95 of adjacent raised surface portions 44 which are spaced to closely accommodate and longitudinally locate therebetween the contact arm of a respective contact as illustrated in FIG. 11.

As is apparent from FIGS. 2, 3 and 11, the contact arm support surfaces 86 and 92 are sufficiently recessed in relation to the ground conductor land surfaces 74 such that the top horizontal surface of contact arms 22 supported thereon also are in recessed relation to the ground conductor land surfaces preferably by an amount in excess of the diameter of signal conductors 6S. The distal end of the junction connecting portion 62 of each contact may extend flush to the respective side surface 76, 77 of the main body 28 while the remainder portion 63 thereof is supported on the respective vertical surface 88, 94 which preferably is recessed in relation to the respective side surface 76, 77 such that the remainder portion of the contact arm has its outer vertical surface flush with the respective side surface of the carrier body. As best seen in FIG. 3, the transition surfaces 87, 93 accommodate the bend of the contact arms when the other angled portions 62 and 63 thereof are respectively supported on the horizontal and vertical surfaces 86, 92 and 88, 94 of the recessed surface portions 43 and 42.

As seen in FIGS. 7 and 10, each recessed surface 88, 94 at its lower end extends longitudinally along the lower longitudinal edge of the respective side surface 76, 77 of the main body 28 to form a respective inset 98, 99 sized to accommodate and locate, as seen in FIG. 11, the base 21 of a respective contact 10 in flush relation to the respective side surface of the main body. The insets 98, 99 at each side surface 76, 77 generally are transversely aligned in pairs to accommodate the bases of a corresponding pair of oppositely facing contacts when the contacts are placed on the carrier as seen in FIG. 11. Each inset 98, 99 has associated therewith at its terminal end a respective pocket 100, 101 adapted to accommodate the similarly angled portion 59 of the carrier arm 51 during placement of contacts on the carrier while still attached in the comb. Once the contacts have been set in place, the remainder of the contact comb may be broken away in one simple bending operation.

The Ground Bus

In FIGS. 12 and 13, the ground bus 13 of the termination 2 is shown separately. The ground bus 13 generally is in the form of a strip of conductive metal such as copper which is bent, from an initial preform shape shown in phantom lines in FIG. 13, to form a base 106, a connecting arm 107 and a ground conductor contact tab 108. As illustrated, the connecting arm 107 is bent at an angle out of the plane of the base 106 and terminates at the ground conductor contact tab 108 which returns and passes through such base plane generally at right angles thereto. The ground bus has a length corresponding to the spacing between the ground bus guide walls 83 of the contact carrier 11 which serve to longitudinally locate the ground bus at its vertical edges in desired longitudinal relation to the contact carrier as seen in FIG. 2. Before the ground bus is bent as shown, the ground conductor contact tab may be coated with solder as indicated at 109.

Briefly reverting to FIGS. 2 and 3, it will be seen that the molded body 4 physically holds the ground bus 13 with its ground conductor contact tab 108 engaged against ground conductors 6G of the cable 3, which ground conductors are supported in coplanar relation on respective ground conductor support lands 81 of the contact carrier 11. The ground conductors are also electrically connected to the ground conductor contact tab at respective electrical junctions 14 which preferably are effected in the manner discussed hereinafter. Accordingly, the ground bus serves to maintain the ground conductors at a common ground or reference potential.

The ground bus 13 also is programmable to provide for electrical connection at electrical junctions 15 to selected signal conductors 6S and respective contacts 10. One or more of the signal conductors and/or contacts may be utilized to bring and maintain the ground bus at ground or reference potential. In accordance with a desired program, the ground bus has signal/ground tabs 110 selectively slit and bent down from the ground conductor contact tab 108 at locations corresponding to the longitudinal positions of respective signal conductors and contacts to be coupled to the ground bus. As seen in FIGS. 2 and 12, three such signal/ground tabs are provided for connection to the first, second and last signal conductors going from left to right. However, more or fewer signal/ground tabs may be provided at any position corresponding to a respective signal conductor and associated contact.

The signal/ground tabs 110 first may be formed by slitting the ground bus when in its preformed shape seen in phantom lines in FIG. 13 and then collectively bent along with the ground conductor contact tab 108 but in downwardly angled projecting relation as shown.

The Cover

FIGS. 14–17 show the details of the cover 5 employed in the preferred termination embodiment, which is shown in FIG. 14 inverted as compared to FIGS. 2 and 3. In addition to those details previously identified, the cover 5 has in its end walls 34 interior guide slots 112 adapted to closely receive the locating tabs 70 provided on the endmost longitudinal wall portions 29 of the contact carrier 11. Each such guide slot terminates at a carrier/stop abutment surface 113 adapted to mate with an opposed surface provided on the contact carrier. Each carrier/stop abutment surface also is outwardly bordered by a flange portion 114 of the respective end wall 34. The flange portions extend between the side walls 35 and provide therewith a planar peripheral surface 115 adapted to mate with a corresponding surface on the molded body 5 when the cover and molded body are assembled together as seen in FIGS. 2 and 3. The flange portions at their inner surfaces abut respective ends of the contact carrier projecting from the molded body and accordingly assist in longitudinally locating the cover on the molded body/contact carrier/etc. subassembly.

In FIGS. 14 and 17, the transverse wall portions 30 defining the cells 36 of the cover 5 can be seen to terminate at a common plane parallel to but inwardly of the mating surface 115. The location of such plane is such that the ends 118 of the transverse wall portions abut the underside of the contact carrier main body 28 which may be slightly vertically offset from the abutment surface 113 to accommodate the correspondingly stepped underside of the contact carrier main body (see FIG. 7). Further in relation to the main body of the contact carrier, the side walls 35 are spaced to closely engage the side surfaces 76 and 77 of the main body to hold the contacts at their base portions securely to the main body as best seen in FIG. 3.

The cover 5 also may be provided with a first pin/designator 120 in the form of an arrow molded on one side wall 35 thereof. Either side wall 35 also may be provided with an alignment/polarity key 121 and other keying devices such as slots 122 adapted to mate with corresponding features of another member such as a pin contact receptacle to which the termination may be connected. The cover also may have mounting or clearance slos 123 provided in the end walls 34 thereof as needed to effect desired mounting or coupling of the termination to another member.

Assembly Method

Figure 19:
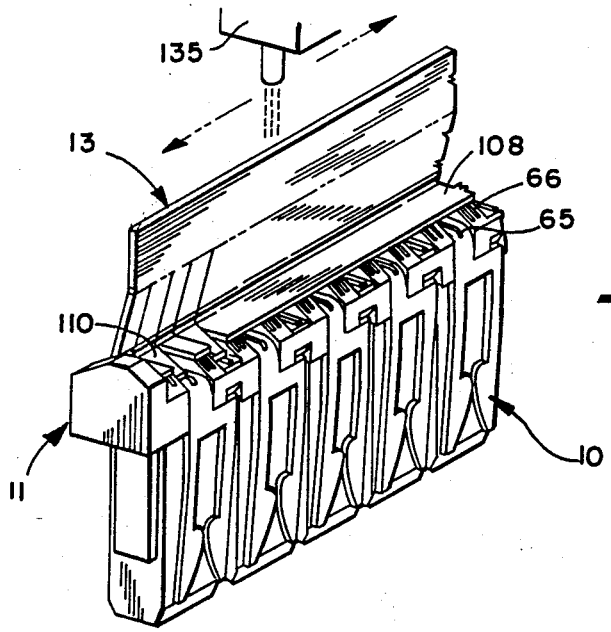
FIGS. 18 and 19 are schematic views depicting a portion of the method of manufacturing a cable termination assembly in accordance with the present invention.
Figure 18:
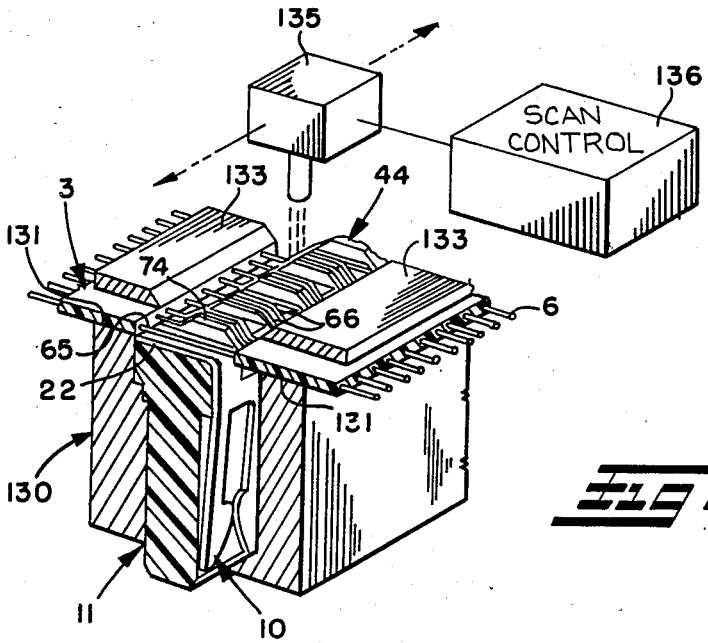

Referring now to FIGS. 18 and 19, a preferred and best mode of assembling the termination 2 and, more particularly, forming the electrical junctions thereof is depicted in part. Initially, a plurality of contacts 10, such as those formed as aforedescribed, are placed on opposite sides of the carrier 11 in a dual in-line pattern with the contacts in one row (on one side) transversely aligned with respective oppositely facing contacts in the other row. This conveniently may be done, for example, before the contacts are separated from the carrier strip seen at 52 in FIGS. 4–6 which facilitates manipulation of the contacts during placement on opposite sides of the contact carrier. During such assembly, the raised surface portions 44 of the contact carrier 11 serve to guide and locate the contact arms 22 of the contacts in proper spaced relation.

Once the contacts 10 have been set into place or in conjunction therewith, the contact carrier 11 with the contacts thereon may be secured in a suitable jig such as that indicated at 130 in FIG. 18. The jig 130 operates to hold the contacts to the contact carrier preferably with the top surfaces of the contact arms generally coplanar or slightly above adjacent clamping surfaces 131 of the jig at opposite sides of the contact carrier/contact subassembly. Consequently, the ground conductor support lands will project upwardly to a greater extent beyond the plane of the clamping surfaces 131.

At this point, a flat or ribbon cable 3 may be laid atop the clamping surfaces 131 of the jig 130. As shown, the cable has insulation removed from an intermediate portion thereof to expose adjacent portions of conductors 6. The exposed portions of the conductors 6 overlie the contact carrier/contact subassembly and are held in engagement therewith when adjacent insulated portions of the cable are clamped to the clamping surfaces by clamping blocks 133.

It will be appreciated that the raised surface portions 44 will serve to guide therebetween signal conductors 6S to supported relation atop respective contact arms 22 of the contacts 10. At the same time, intermediate ground conductors 6G, pairs of which are typically more closely spaced to one another than to adjacent signal conductors, will be aligned and supported atop the ground conductor support lands 74, such ground conductors being displaced by the raised support lands slightly out of the plane of the signal conductors 6S.

With the conductors 6, contacts 10 and contact carrier 11 arranged and preferably held in a jig as shown, electromagnetic radiation may then be applied to the engaged signal conductors 6S and respective contact arms 22 to cause the solder on the latter to flow and join upon solidification respective electrical contacts and signal conductors both physically and electrically to form the aforementioned electrical junctions 12 therebetween. Preferably, application of the electromagnetic radiation is effected by scanning respective junctions using a laser indicated at 135 and scan control 136. Preferably the solder on the contact arms is coated black or otherwise darkened or dulled to absorb the laser beam striking thereagainst to effect heating and reflow of the solder. Otherwise the laser beam might be reflected with insufficient or no solder heating and reflow.

As indicated, the signal conductors 6S, the contact arms 22 and the junctions therebetween will be isolated or separated from adjacent signal conductors, contact arms and junctions by the intermediate raised surface portions 44 which longitudinally locate respective contact arms therebetween.

The laser scanning procedure also may be employed to attach the ground or reference potential conductors 6G to the common ground bus 13. The ground bus may be lowered as seen in FIG. 19 to bring the ground conductor contact tab 108 into engagement with the ground conductors supported atop respective ground conductor support lands 74. At the same time, any signal/ground tabs 110 which have been provided will or may be brought into engagement with respective signal conductors 6S. During this, the contact/carrier/cable subassembly may still be held in the jig 130 although not illustrated in FIG. 19, and suitable means provided to hold the bus in place. With the ground bus held in such position, electromagnetic radiation may be applied to each junction location, as by again scanning with the laser 135, to heat and flow the solder on the underside of the ground bus tabs to form the mechanical and electrical junction 14 between the ground conductor tab and the ground conductors and the junctions 15 between the signal/ground tabs and respective signal conductors 6S used to carry ground reference potential. As illustrated, the beam may be applied against the top sides of the ground bus tabs preferably coated black to absorb the beam for desired heating and reflow of the solder on the underside of such tabs.

After the various electrical junctions have been formed as aforedescribed or in other suitable manner, the contacts 10, contact carrier 11, ground bus 13 and cable 3 may be placed into a suitable mold for molding thereabout the strain relief body 4 which forms a unified structure with at least a part of the junctions, carrier, contacts, ground bus and conductors. Thereafter, the molded strain relief body and cover 5 may be assembled and joined as by ultrasonic welding techniques to form the finished termination.

It should be noted that the foregoing detailed description of the termination 2 and its manner of assembly is made by way of example and that modification may be made while still following principles of the present invention. For example, details of the cable end termination 1 may differ from those of the cable intermediate termination 2 at least for the reason that the cable need not extend from both sides thereof. Rather, the cable 3 may terminate interiorly of the molded strain relief body of a cable end termination at a point beyond the various electrical junctions between conductors therein, the contacts and ground bus of such termination.

Although the invention has been described with respect to a preferred embodiment, it is obvious that equivalent alterations and modifications will occur to others skilled in the art upon the reading and understanding of this specification. The present invention includes all such equivalent alterations and modifications, and is limited only by the scope of the following claims.

STATEMENT OF INDUSTRIAL APPLICATION

In view of the foregoing it will be appreciated that the present invention may be practiced to terminate conductors of an electrical cable, especially of flat transmission line type, in a highly desirable and facile manner which affords improved integrity of electrical and mechanical connections between conductors, contacts, etc. in the resultant cable termination assembly.

I claim:

1. A cable termination assembly, comprising an electrical cable including plural electrical conductors having insulation therefor part removed to expose adjacent portions of said conductors;

plural electrical contacts including connecting means for connecting electrically with respective conductors at exposed portions thereof and coupling means for electrically coupling with another member;

carrier means for supporting said contacts in close packed relation;

electrical junctions between connecting means of respective contacts and exposed portions of some conductors of said cable, and body means molded about at least a part of said junctions, carrier means, contacts and conductors to form a unified structure;

said carrier means including alternating recessed and raised surface portions, said recessed surface portions accommodating respective connecting means of said contacts, said raised surface portions separating adjacent connecting portions of said contacts and isolating adjacent exposed portions of said some conductors joined to respective connecting means, and said raised surface portions having respective raised surfaces elevated above adjacent connecting portions and the conductors joined thereto to displace thereabove the exposed portions of other conductors.

2. An assembly as set forth in claim 1, further comprising bus means for coupling in electrical parallel said other conductors, and said body means is molded about at least a part of said bus means to include said bus means in said unified structure.

3. An assembly as set forth in claim 2, wherein said bus means includes coplanar ground tab means electrically connected to said other conductors.

4. An assembly as set forth in claim 3, wherein said bus means further includes at least one other tab means electrically connected to a respective one of said some conductors.

5. An assembly as set forth in claim 4, wherein said other tab means is slit from and bent out of the plane of said ground tab means.

6. An assembly as set forth in claim 2, wherein said carrier means includes at its ends opposed abutment means for locating said bus means therebetween.

7. An assembly as set forth in claim 1, wherein said contacts are supported in rows on opposite sides of said carrier means with the connecting means of contacts in one row being accommodated by respective recessed portions alternating with recessed portions accommodating respective connecting means of contacts in the other row.

8. An assembly as set forth in claim 7, wherein each side of said carrier means has recesses accommodating respective contacts in substantially flush relation thereto.

9. An assembly as set forth in claim 8, wherein said side recesses at each side of said carrier means are transversely aligned with respective recesses at the other side of said carrier means to locate respective contacts in opposite rows in transversely aligned pairs.

10. An assembly as set forth in claim 9, wherein said contacts each include a base portion interconnecting said connecting means and coupling means, said base portion being received in a respective side recess.

11. An assembly as set forth in claim 10, wherein said connecting means of each contact includes an inwardly extending contact arm, the contact arms of contacts in one row being offset in one longitudinal direction on said carrier means while those of contacts in the other row are offset in the opposite longitudinal direction, such that the contact arms of contacts in one row are accommodated by respective recessed surface portions alternating with recessed portions accommodating the contact arms of contacts in the other row.

12. An assembly as set forth in claim 11, wherein said some conductors of said cable are ordinarily held in spaced parallel relation by said insulation, and adjacent contact arms are located by and between adjacent raised surface portions parallel to and at the same spacing of said some conductors in said insulation.

13. An assembly as set forth in claim 1, wherein adjacent raised surface portions have opposed parallel wall surfaces locating a respective connecting means therebetween.

14. An assembly as set forth in claim 1, wherein said some conductors are ordinarily held in spaced parallel relation by said insulation, and said recessed surface portions are separated at the same spacing of said some conductors by said raised surface portions.

15. An assembly as set forth in claim 1, wherein said carrier means further includes partition walls separating the coupling means of contacts placed in parallel rows on opposite sides of said carrier means.

16. An assembly as set forth in claim 15, further comprising cover means cooperable with said partition walls to form discrete compartments for respective coupling means of said contacts and into which such another member may be inserted for connection with respective coupling means.

17. Apparatus for terminating plural insulated electrical conductors having uninsulated portions thereof positioned in generally parallel coplanar relation, comprising said electrical conductors;

plural electrical contacts including connecting means for connecting electrically with respective conductors at the uninsulated portions thereof and coupling means for electrically coupling with another member;

electrical junctions between connecting means of respective contacts and some of said conductors;

carrier means for supporting said contacts, said carrier means including an elongate body having along the length thereof alternating recessed and raised surface portions accommodating respective connecting means of said contacts, said raised surface portions separating adjacent connecting portions of said contacts and isolating adjacent uninsulated portions of said some conductors joined to respective connecting means, and said raised surface portions having respective raised surfaces elevated above adjacent connecting portions and the conductors joined thereto to displace thereabove the uninsulated portions of other conductors; and holder means for securely holding in relative position at least a part of said carrier means, contacts and such portions of the conductors.

18. Apparatus as set forth in claim 17, wherein said recessed surface portions have respective coplanar recessed surfaces for supporting connecting means of respective contacts thereon in generally coplanar relation.

19. Apparatus as set forth in claim 18, wherein said raised surfaces are coplanar for supporting the uninsulated portions of respective ones of said other conductors in a common plane above the plane of the uninsulated portions of said some conductors in electrical contact with respective connecting means supported on respective recessed surfaces.

20. Apparatus as set forth in claim 19, wherein said raised surfaces extend between sloped transition surfaces terminating at respective sides of said body.

21. Apparatus as set forth in claim 17, wherein said contacts are supported in rows on opposite sides of said body with the connecting means of contacts in one row being accommodated by respective recessed portions alternating with recessed portions accommodating respective connecting means of contacts in the other row.

22. Apparatus as set forth in claim 21, further comprising bus means for coupling in electrical parallel said other conductors.

23. Apparatus as set forth in claim 22, wherein said bus means includes coplanar ground tab means electrically connected to said other conductors.

24. Apparatus as set forth in claim 23, wherein said bus means further includes at least one other tab means electrically connected to a respective one of said other conductors.

25. Apparatus as set forth in claim 22, wherein said carrier means includes at its ends opposed abutment means for locating said bus means therebetween.

26. Apparatus as set forth in claim 17, wherein each side of said carrier means has recesses accommodating respective contacts in flush relation thereto.

27. Apparatus as set forth in claim 26, wherein said side recesses at each side of said carrier means are transversely aligned with respective recesses at the other side of said carrier means to locate the contacts in transversely aligned pairs.

28. Apparatus as set forth in claim 27, wherein said contacts each include a base portion interconnecting said connecting means and coupling means, said base portion being received in a respective side recess.

29. Apparatus as set forth in claim 17, wherein said connecting means of each contact includes an inwardly extending contact arm, the contact arms of contacts in one row being offset in one longitudinal direction on said carrier means while those of contacts in the other row are offset in the opposite longitudinal direction, such that the contact arms of contacts in one row are accommodated by respective recessed surface portions alternating with recessed portions accommodating the contact arms of contacts in the other row.

30. Apparatus as set forth in claim 29, wherein said conductors are ordinarily held in spaced parallel relation by insulation, and adjacent contact arms are located at the same spacing of said some conductors in said insulation by and between adjacent raised surface portions.

31. Apparatus as set forth in claim 17, wherein adjacent raised surface portions have opposed parallel wall surfaces locating a respective connecting means therebetween.

32. Apparatus as set forth in claim 17, wherein said conductors are ordinarily held in spaced parallel relation by insulation, and said recessed surface portions are separated by said raised surface portions at the same spacing of said some conductors.

33. Apparatus as set forth in claim 17, wherein said carrier means further includes partition walls separating the coupling means of contacts placed in parallel rows on opposite sides of said carrier means.

34. Apparatus as set forth in claim 33, further comprising cover means cooperable with said partition walls to form discrete compartments for respective coupling means of said contacts and into which such another member may be inserted for connection with respective coupling means.

35. Apparatus as set forth in claim 17, wherein said holder means includes a strain relief body molded directly about at least a part of said carrier means, contacts and such portions of the conductors.

36. Apparatus as set forth in claim 17, wherein said raised surfaces extend between sloped transition surfaces terminating at respective sides of said body.

37. A cable termination assembly, comprising a ribbon type electrical cable including plural electrical conductors physically held in relative parallel coplanar relation by electrical insulation, part of said insulation being removed to expose adjacent portions of said conductors;

plural electrical contacts including connecting means for connecting electrically with respective conductors at exposed portions thereof and coupling means for electrically coupling with another member;

carrier means for supporting said contacts, said carrier means including separating means for separating respective electrical contacts placed on said carrier means and guide means for guiding respective electrical conductors to connect electrically with respective electrical contacts;

electrical junctions between respective electrical contact connecting means and electrical conductors;

programmable bus means for coupling in electrical parallel selected ones of said conductors; and holder means for holding securely in relative position at least a part of said junctions, carrier means, electrical contacts, electrical conductors and bus means;

said separating means including support means for supporting some conductors in a plane displaced from a plane containing said electrical junctions, said bus means including coplanar ground tab means electrically connected to the exposed portions of said some conductors supported by said support means and at least one other tab means electrically connected to a selected one of said conductors forming an electrical junction with a respective connecting means of a contact, and said other tab means being slit from and bent out of the plane of said ground tab means.

38. An assembly as set forth in claim 37, wherein said other tab means is slit from and bent out of the plane of said ground tab means.

39. An assembly as set forth in claim 37, wherein said carrier means includes at its ends opposed abutment means for locating said bus means therebetween.

40. An assembly at set forth in claim 37, wherein said guide means includes spaced walls for locating therebetween respective connecting means at a spacing coinciding with the spacing of those conductors in the cable which form said electrical junctions with respective contact means.

41. An assembly as set forth in claim 37, wherein said carrier means includes an elongate body having along the length thereof alternating raised and recessed surface portions cooperably forming said separating means and guide means, said recessed and raised surface portions of said carrier means respectively accommodating and separating adjacent connecting means of contacts placed on said carrier means.

42. An assembly as set forth in claim 41, wherein said recessed surface portions have respective coplanar recessed surfaces for supporting connecting means of respective contacts thereon in generally coplanar relation.

43. An assembly as set forth in claim 41, wherein said contacts are supported in rows on opposite sides of said body with the connecting means of contacts in one row being accommodated by respective recessed portions alternating with recessed portions accommodating respective connecting means of contacts in the other row.

44. A cable termination assembly comprising electrical conductors having adjacent portions thereof in relative parallel coplanar relation;

plural electrical contacts including connecting means for connecting electrically with respective conductors at such adjacent portions and coupling means for electrically coupling with another member;

means for supporting said contacts with the connecting means thereof in spaced coplanar relation and in respective electrical contacts with some of said conductors at such adjacent portions thereof;

means for supporting the other of said conductors at such adjacent portions thereof in coplanar relation out of the plane of the adjacent portions of said some of said conductors;

ground bus means including coplanar ground conductor tab means in electrical contact with said other of said conductors at the adjacent portions thereof; and means for holding securely in relative position at least a part of said conductors, carrier means, contacts and ground bus means;

said ground bus means including programmable signal/ground tab means for effecting selective electrical connection between said ground bus means and at least one contact, said signal/ground tab means being slit from and bent out of the plane of said ground conductor tab means.

45. A cable termination assembly, comprising a ribbon type electrical cable including plural electrical conductors physically held in relative parallel coplanar relation by electrical insulation, part of said insulation being removed to expose adjacent portions of said conductors;

plural electrical contacts including connecting means for connecting electrically with respective conductors at exposed portions thereof and coupling means for electrically coupling with another member;

carrier means for supporting said contacts, said carrier means including separating means for separating respective electrical contacts placed on said carrier means and guide means for guiding respective electrical conductors to connect electrically with respective electrical contacts;

electrical junctions between respective electrical contact connecting means and some of said electrical conductors;

programmable bus means for coupling in electrical parallel selected ones of said conductors; and holder means for holding securely in relative position at least part of said junctions, carrier means, electrical contacts, electrical conductors and bus means;

said carrier means including an elongate body having along the length thereof alternating raised and recessed surface portions cooperably forming said separating means and guide means, said recessed and raised surface portions of said carrier means respectively accommodating and separating adjacent connecting means of contacts placed on said carrier means, said recessed surface portions having respective coplanar recessed surfaces for supporting connecting means of respective contacts thereon in generally coplanar relation, said raised surface portions having respective coplanar raised surfaces for supporting the uninsulated portions of said selected ones of said conductors out of the plane of the uninsulated portions of said some conductors in electrical contact with respective connecting means supported on respective recessed surfaces, and said raised surfaces extending between sloped transition surfaces terminating at respective sides of said body.

46. A cable terminating assembly, comprising a ribbon type electrical cable including plural electrical conductors physically held in relative parallel coplanar relation by electrical insulation, part of said insulation being removed to expose adjacent portions of said conductors;

plural electrical contacts including connecting means for connecting electrically with respective conductors at exposed portions thereof and coupling means for electrically coupling with another member;

carrier means for supporting said contacts, said carrier means including separating means for separating respective electrical contacts placed on said carrier means and guide means for guiding respective electrical conductors to connect electrically with respective electrical contacts;

electrical junctions between respective electrical contact connecting means and electrical conductors;

programmable bus means for coupling in electrical parallel selected ones of said conductors; and holder means for holding securely in relative position at least a part of said junctions, carrier means, electrical contacts, electrical conductors and bus means, said holder means including a strain relief body molded directly about at least a part of said carrier means, contacts, electrical junctions, bus means and said portions of the conductors.

* * * * *